US006988069B2

(12) United States Patent
Phillips

(10) Patent No.: US 6,988,069 B2
(45) Date of Patent: Jan. 17, 2006

(54) REDUCED UNIT DATABASE GENERATION BASED ON COST INFORMATION

(75) Inventor: Michael Stuart Phillips, Boston, MA (US)

(73) Assignee: Speechworks International, Inc., Boston, MA (US)

( * ) Notice: Subject to any disclaimer, the term of this patent is extended or adjusted under 35 U.S.C. 154(b) by 131 days.

(21) Appl. No.: 10/355,143

(22) Filed: Jan. 31, 2003

(65) Prior Publication Data

US 2004/0153324 A1 Aug. 5, 2004

(51) Int. Cl.
*G10L 13/00* (2006.01)

(52) U.S. Cl. ..... 704/258; 704/260

(58) Field of Classification Search ..... 704/277, 704/270, 260, 259, 258, 257, 254, 241, 220, 704/211

See application file for complete search history.

(56) References Cited

U.S. PATENT DOCUMENTS

| | | | | |
|---|---|---|---|---|
| 6,173,263 | B1 | 1/2001 | Conkie | |
| 6,260,016 | B1 | 7/2001 | Holm et al. | |
| 6,366,883 | B1 | 4/2002 | Campbell et al. | |
| 6,665,641 | B1 | 12/2003 | Coorman et al. | |
| 2002/0143543 | A1 * | 10/2002 | Sirivara | 704/260 |
| 2003/0212555 | A1 * | 11/2003 | van Santen | 704/241 |
| 2003/0229494 | A1 * | 12/2003 | Rutten et al. | 704/254 |

FOREIGN PATENT DOCUMENTS

WO WO 00/30069 5/2000

OTHER PUBLICATIONS

Conkie et al. "Preselection of Candidate Units in a Unit Selection–based Text–to–Speeh Synthesis System," ICSLP 2000, vol. III, Oct 2000, pp. 314–317.*

Donovan et al. "Segment Pre–selection in Decision–Tree Based speech Snythesis Systems," ICASSP, vol. 2, Jun. 2000, pp. II937–II940.*

Hon et al. "Automatic Generataion of Synthesis Units for Trainable Text–to–Speech Systems," ICASSP 1998, May 1998, pp. 293–296.*

Yi et al. "Information–Theoretic Criteria for Unit Selection Synthesis," ICSLP 2002, Sep. 2002, pp. 2617–2620.*

Hunt et al., "Unit selection in a concatenative speech synthesis system using a large speech database," ATR Interpreting Tele. Res. Labs., *Proc. ICASSP–96, May 7–10, Atlanta GA*.

Conkie, "Robust unit selection system for speech synthesis," AT&T Labs—Research, Florham Park, NJ.

Beutnagel et al., "The AT&T next–gen TTS system," AT&T Labs—Research, Florham Park, NJ.

Balestri, et al "Chose the Best to Modify the Least A New Generatoin Concatenative Synthesis System" Proc. Eurospeech '99, Budapest, Sep. 5–9, 1999, vol. .5, pp. 2291–2294.

Rutten et al "issues in Corpus Based Speech Synthesis," Proc. IEE Symposium on State –of the Art in Speech Synthesis, Savoy Place, London, 2000, pp. 16/1–16/7.

Wightman et al, "Automatic labeling of Prosodic Patterns" IEEE Trans. on Speech and Audio Proc., Oct. 1994, vol. 2, No. 4, pp. 469–481.

* cited by examiner

*Primary Examiner*—Richemond Dorvil
*Assistant Examiner*—V. Paul Harper
(74) *Attorney, Agent, or Firm*—Pillsbury Winthrop Shaw Pittman LLP

(57) ABSTRACT

An arrangement is provided for generating a reduced unit database of a desired size to be used in text to speech operations. A reduced unit database with a desired size is generated based on a full unit database. The reduction is carried out with respect to a text database with a plurality of sentences. Units from the full database are pruned to minimize an overall cost associated with using alternative units other than the units in the reduced unit database.

47 Claims, 11 Drawing Sheets

835

REDUCED UNIT DATABASE GENERATION BASED ON COST INFORMATION

BACKGROUND

Modern technologies have made it possible to conduct communication using different devices and in different forms. Among all possible forms of communication, speech is often a preferred way to conduct communications. For example, service companies more and more often deploy interactive response (IR) systems in their call centers that automates the process of providing answers to customers' inquiries. This may save these companies millions of dollars that are otherwise necessary to operate a man-operated call center. In situations where a communication device lacks real estate, speech may become the only meaningful way to communicate. For example, a person may check electronic mails using a cellular phone. In this case, the electronic mails may be read (instead of displayed) to the person through text to speech. That is, electronic mails in text form are converted into synthesized speech in waveform which is then played back to the person via the cellular phone.

When speech is used for communication, generating synthesized speech with natural sound is desirable. One approach to generating natural sounding synthesized speech is to select phonetic units from a large unit database. However, the size of a unit database used by a text to speech processing mechanism may be constrained by factors related to the device (e.g., a computer, a laptop, a personal data assistant, or a cellular phone) on which the text to speech processing mechanism is deployed. For example, the memory size of the device may limit the size of a unit database.

BRIEF DESCRIPTION OF THE DRAWINGS

The inventions claimed and / or described herein are further described in terms of exemplary embodiments. These exemplary embodiments are described in detail with reference to the drawings. These embodiments are non-limiting exemplary embodiments, in which like reference numerals represent similar parts throughout the several views of the drawings, and wherein:

DETAILED DESCRIPTION

The processing described below may be performed by a properly programmed general-purpose computer alone or in connection with a special purpose computer. Such processing may be performed by a single platform or by a distributed processing platform. In addition, such processing and functionality can be implemented in the form of special purpose hardware or in the form of software or firmware being run by a general-purpose or network processor. Data handled in such processing or created as a result of such processing can be stored in any memory as is conventional in the art. By way of example, such data may be stored in a temporary memory, such as in the RAM of a given computer system or subsystem. In addition, or in the alternative, such data may be stored in longer-term storage devices, for example, magnetic disks, rewritable optical disks, and so on. For purposes of the disclosure herein, a computer-readable media may comprise any form of data storage mechanism, including such existing memory technologies as well as hardware or circuit representations of such structures and of such data.

Figure 1:
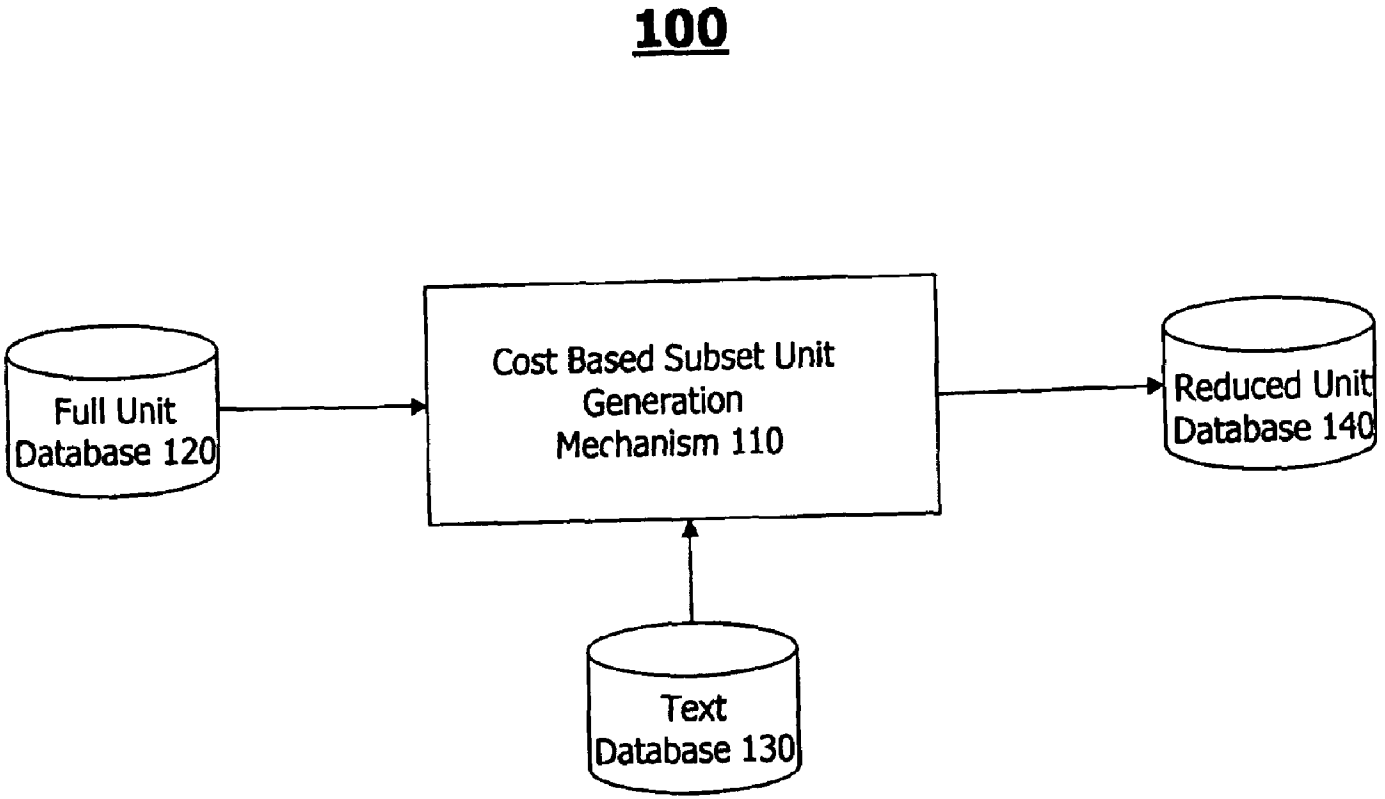
FIG. 1 depicts an exemplary framework, in which a cost based subset unit generation mechanism produces a reduced unit database from a full unit database, according to embodiments of the present invention.

FIG. 1 depicts an exemplary framework 100, in which a cost based subset unit generation mechanism 110 produces a reduced unit database 140 from a full unit database 120, according to embodiments of the present invention. The full unit database 120 may include a plurality of phonetic units, which may be any one of a phoneme, a half-phoneme, a di-phone, a bi-phone, or a syllable. A phoneme is a basic sound of a language. For example, a word is a sequence of phonemes. A half-phoneme is either the first or the second half of a phoneme in terms of time. A bi-phone is a pair of two adjacent phonemes. A di-phone comprises two half phonemes one of which is a second half phoneme of a first phoneme and the other is a first half phoneme of a second phoneme adjacent to the first phoneme in time.

A unit may be represented as an acoustic signal such as a waveform associated with a set of attributes. Such attributes may include a symbolic label indicating the name of the unit or a plurality of computed features. Each of the units stored in a unit database may be selected and used to synthesize the sound of different words. When a textual sentence (or a phrase or a word) is to be converted to corresponding speech sound (text to speech), appropriate phonetic units corresponding to different sounding parts of the spoken sentence are selected from a unit database in order to synthesize the sound of the entire sentence. The selection of the appropriate units may be performed according to, for example, how closely the synthesized words will sound like some specified desired sound of these words or whether the synthesized speech sounds natural.

The closeness between synthesized speech and some desired sound may be measured based on some features. For example, it may be measured according to the pitch of the synthesized voice. The natural sounding of synthesized speech may also be measured according to, for instance, the smoothness of the transitions between adjacent units. Individual units may be selected because their acoustic features are close to what is desired. However, when connecting adjacent units together, abrupt changes in acoustic characteristics from one unit to the next may make the resulting speech sound unnatural. Therefore, a sequence of units chosen to synthesize a word or a sentence may be selected according to both acoustic features of individual units as well as certain global characteristics when concatenating such units. When a unit sequence is selected from a larger unit database, it is usually more likely to yield results that produce speech that sounds closer to what is desired.

The full unit database 120 provides a plurality of units as primitives to be selected to synthesize speech from text. The cost based subset unit generation mechanism 110 produces a smaller unit database, the reduced unit database 140, based on the full unit database 120. The smaller unit database includes a subset of units from the full unit database 120 and has a particular size determined, for example, to be appropriate for a specific application (e.g., that performs text to speech operations) running on a particular device (e.g., a personal data assistance or PDA).

The units to be included in the reduced unit database 140 may be determined according to certain criteria. In different embodiments of the present invention, the cost based subset unit generation mechanism 10 may prune units from the full unit database 120 and select a subset of the units to be included in the reduced unit database 140 based on whether the selected units yield adequate performance in speech synthesis in a given operating environment. The merits of the units may be evaluated with respect to a plurality of sentences in a text database 130. For example, assume the desired size of the reduced unit database 140 is n. Then, n best units may be chosen (from the full unit database 120) in such a manner that they produce speech best synthesis outcome on part or all of the sentences in the text database 130.

The sentences in the text database 130 used for such evaluation may be determined according to the needs of applications that use the reduced unit database 140 for text to speech processing. In this fashion, units that are selected to be included in the reduced unit database 140 may correspond to the units that are most suitable for the needs of the applications. For example, an application may be designed to provide users assistance in getting driving direction while they are on roads. In this case, vocabulary used by the application may be relatively limited. That is, the units needed for synthesizing speech for this particular application may be accordingly limited. In this case, the sentences in the text database 130 used in evaluating units for the reduced unit database may include typical sentences used in applicable scenarios. In addition, the application may choose a particular speaker as a target speaker in generating voice responses to users' queries.

Units chosen with respect to the sentences in the text database 130 form a pool of candidate units that may be further pruned to generate the reduced unit database 140. The units selected to be included in the reduced unit database 140 may be compressed to further reduce required storage space. Units in the reduced unit database 140 may also be properly indexed to facilitate fast retrieval. Different embodiments of the present invention may be realized to generate the reduced unit database 140 in which selected units may be compressed either after they are selected or before they are selected. The determination of employing a particular embodiment in practice may depend on application or system related factors.

Figure 2:
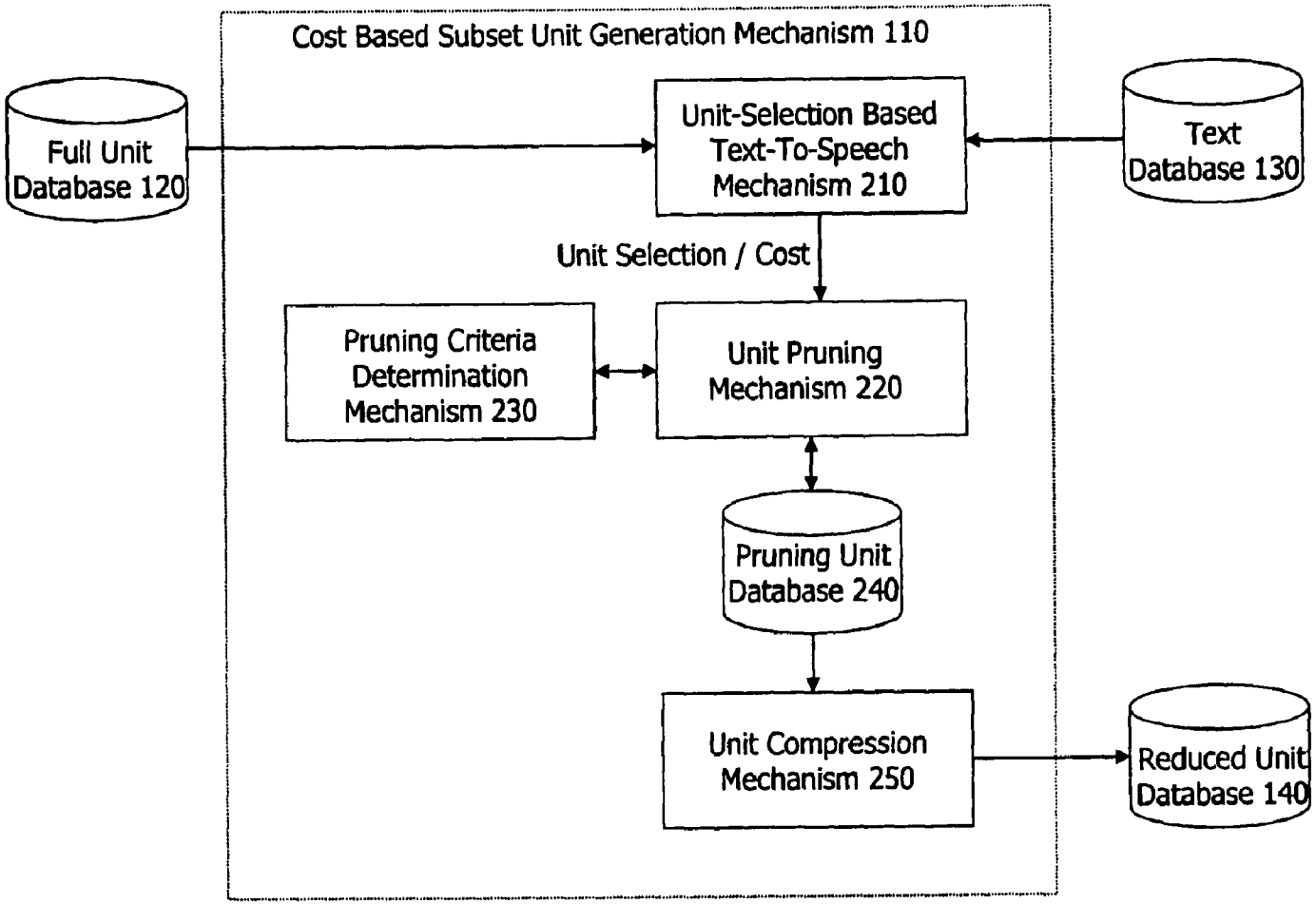
FIG. 2 depicts a high level functional block diagram of a first exemplary realization of a cost based subset unit generation mechanism which compresses units after pruning operation, according to embodiments of the present invention.

FIG. 2 depicts a high level functional block diagram of a first exemplary realization of the cost based subset unit generation mechanism 110, according to embodiments of the present invention. In this first realization, the cost based subset unit generation mechanism 110 compresses units of the reduced unit database 140 after such units are selected. The first exemplary realization of the cost based subset unit generation mechanism 110 includes a unit selection based text-to-speech mechanism 210, a unit pruning mechanism 220, a pruning criteria determination mechanism 230, a pruning unit database 240, and a unit compression mechanism 250, all arranged so that compression of units takes place after unit pruning operation is completed.

The unit-selection based text-to-speech mechanism 210 performs speech synthesis of the sentences from the text database 130 using phonetic units that are selected from the full unit database 120 based on cost information. Such cost information may measure how closely the synthesized speech using the selected units will sound like some desired sound defined in terms of different aspects of speech. In other words, the cost information based on which unit selection is performed characterizes the deviation of the synthesized speech from desired speech properties. Units may be selected so that the deviation or the cost is minimized.

Cost information associated with a sentence may be designed to capture various aspects related to quality of speech synthesis. Some aspects may relate to the quality of sound associated with individual phonetic units and some may relate to the acoustic quality of concatenating different phonetic units together. For example, desired speech property of individual phonemes (units) may be defined in terms of pitch and duration of each phoneme. If the pitch and duration of a selected phoneme differ from the desired pitch and duration, such difference in acoustic features leads to different sounds in synthesized speech. The bigger the difference in pitch or/and duration, the more the resulting speech deviates from desired sound.

The cost information may also include measures that capture the deviation with respect to context mismatch, evaluated in terms of whether the desired context of a target unit sequence (generated based on a textual sentence) matches the context of a sequence of units selected from a unit database in accordance with the desired unit sequence. The context of a selected unit sequence may not match exactly the desired context of the corresponding target unit sequence. This may occur, for example, when a desired context within a target unit sequence does not exist in the full unit database 130. For instance, for the word "pot" which has a/a/ sound as in the word "father" (desired context), the full unit database 120 may have only units corresponding to phoneme /a/ appearing in the word "pop" (a different context). In this case, even though the /t/ sound as in the word "pot" and the /p/ sound as in the word "pop" are both consonants, one (/t/) is a dental (the sound is made at the teeth) and the other (/p/) is a labial (the sound is made at the lips). This contextual difference affects the sound of the previous phoneme /a/. Therefore, even though the phoneme /a/ in the full unit database 120 matches the desired phoneme, due to contextual difference, the synthesized sound using the phoneme /a/ selected from the context of "pop" is not the same as the desired sound determined by the context of "pot". The magnitude of this effect may be evaluated by a so-called context cost and may be measured according to different types of context mismatch. The higher the cost, the more the resulting sound deviates from the desired sound.

The cost information may also describe quality of unit transitions. Homogeneous acoustic features across adjacent units may yield smooth transition (which may correspond to more natural speech). Abrupt changes in acoustic properties between adjacent units may degrade transition quality. The difference in acoustic features of the waveforms of corresponding units at points of concatenation may be computed as concatenation cost. For instance, concatenation cost of the transition between two adjacent phonemes may be measured as the difference in cepstra computed near the point of the concatenation of the waveforms corresponding to the phonemes. The higher the difference is, the less smooth the transition of the adjacent phonemes.

In synthesizing a textual sentence, a cost associated with synthesizing the speech of the sentence may bc computed as a combination of different aspects of the above mentioned costs. For instance, a total cost associated with generating the speech form of a sentence may be a summation of all costs associated with individual phonetic units, the context cost, and the concatenation costs computed between every pair of adjacent units. In unit selection based text to speech processing, a unit sequence with respect to a textual sentence is selected in such a way that the total cost associated with the selected unit sequence is minimized.

To synthesize a sentence from the text database 130, the unit-selection based text-to-speech mechanism 210 selects a sequence of units from the full unit database 120 that, when synthesized, corresponds to the spoken version of the sentence. In addition, the units in the unit sequence are selected so that the total cost is minimized. For each of the sentences in the text database 130, the unit-selection based text-to-speech mechanism 210 outputs a selected unit sequence with corresponding total cost information. From such an output, it can be determined which units are selected and what is the total cost associated with the selected unit sequence.

The unit pruning mechanism 220 determines which units to be included in the reduced unit database 140 according to one or more pruning criteria, determined by the pruning criteria determination mechanism 230. The unit pruning mechanism 220 takes the outputs of the unit-selection based text-to-speech mechanism 210 as input, which comprises a plurality of selected unit sequences. The unit pruning mechanism 230 prunes the units included in the selected unit sequences based on both the cost associated with the selected unit sequences as well as the pruning criteria. The details related to the pruning operation are discussed with reference to FIGS. 4, 5, 8, and 9.

During the pruning process, the unit pruning mechanism 220 may store units to be pruned in a temporary pruning unit database 240. When the pruning process yields desired number of pruned units, the unit compression mechanism 250 compresses the remaining units and generate the reduced unit database 140 using the compressed units.

Figure 3:
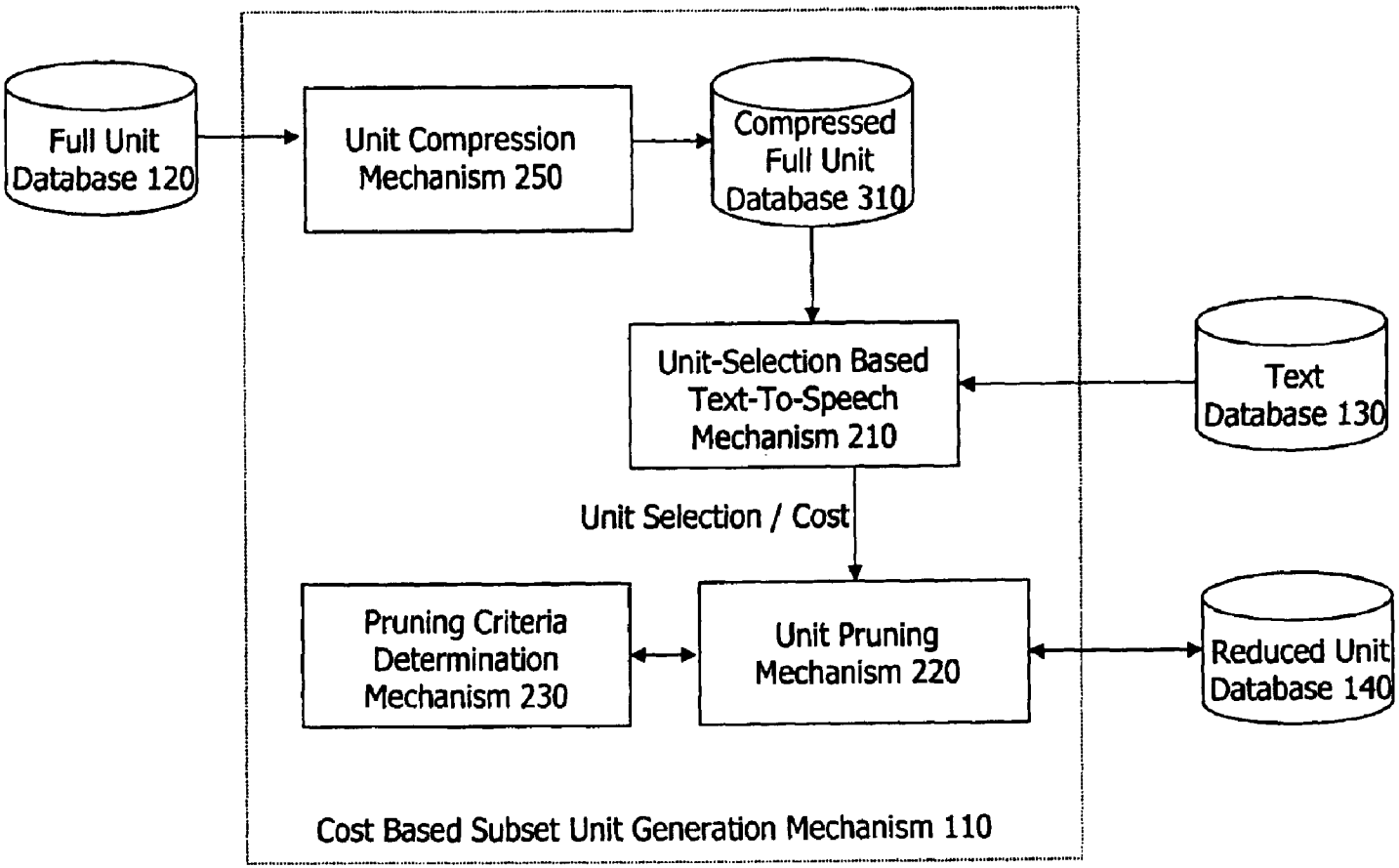
FIG. 3 depicts a high level functional block diagram of a second exemplary realization of a cost based subset unit generation mechanism that compresses unit prior to pruning operation, according to embodiments of the present invention.

FIG. 3 depicts a high level functional block diagram of a second exemplary realization of the cost based subset unit generation mechanism 110, according to embodiments of the present invention. In this second exemplary realization of the cost based subset unit generation mechanism, the units in the full unit database 120 are compressed before the unit-selection based text-to-speech mechanism 210 performs unit selection in synthesizing the sentences from the text database 130. The second exemplary realization of the cost based subset unit generation mechanism 110 comprises the unit compression mechanism 250, a compressed full unit database 310, the unit selection based text-to-speech mechanism 210, the unit pruning mechanism 220, and the pruning criteria determination mechanism 230, arranged so that compression of units takes place prior to unit selection based text to speech processing.

The unit compression mechanism 250 first compresses all units in the full unit database 120 to generate the compressed full unit database 310. The unit-selection based text-to-speech mechanism 210 selects compressed units from the compressed full unit database 310. Although selecting units in their compressed forms may affect the outcome of the selection (compared with selecting based on non-compressed units), this realization of the invention may be used for applications where it is preferable that unit selection in generating the reduced unit database is performed under a similar operational condition (i.e., use compressed units) as it would be in real application scenarios.

The unit pruning mechanism 220 determines which units to be included in the reduced unit database 140 based on the cost information associated with each of the selected unit sequences generated with respect to the sentences of the text database 130. The units selected with respect to the sentences in the text database 130 are pruned according to some pruning criteria set up by the pruning criteria determination mechanism 230. When the number of the selected units reaches a desired number, the reduced unit database 140 is formed using the selected units in their compressed forms.

Figure 4:
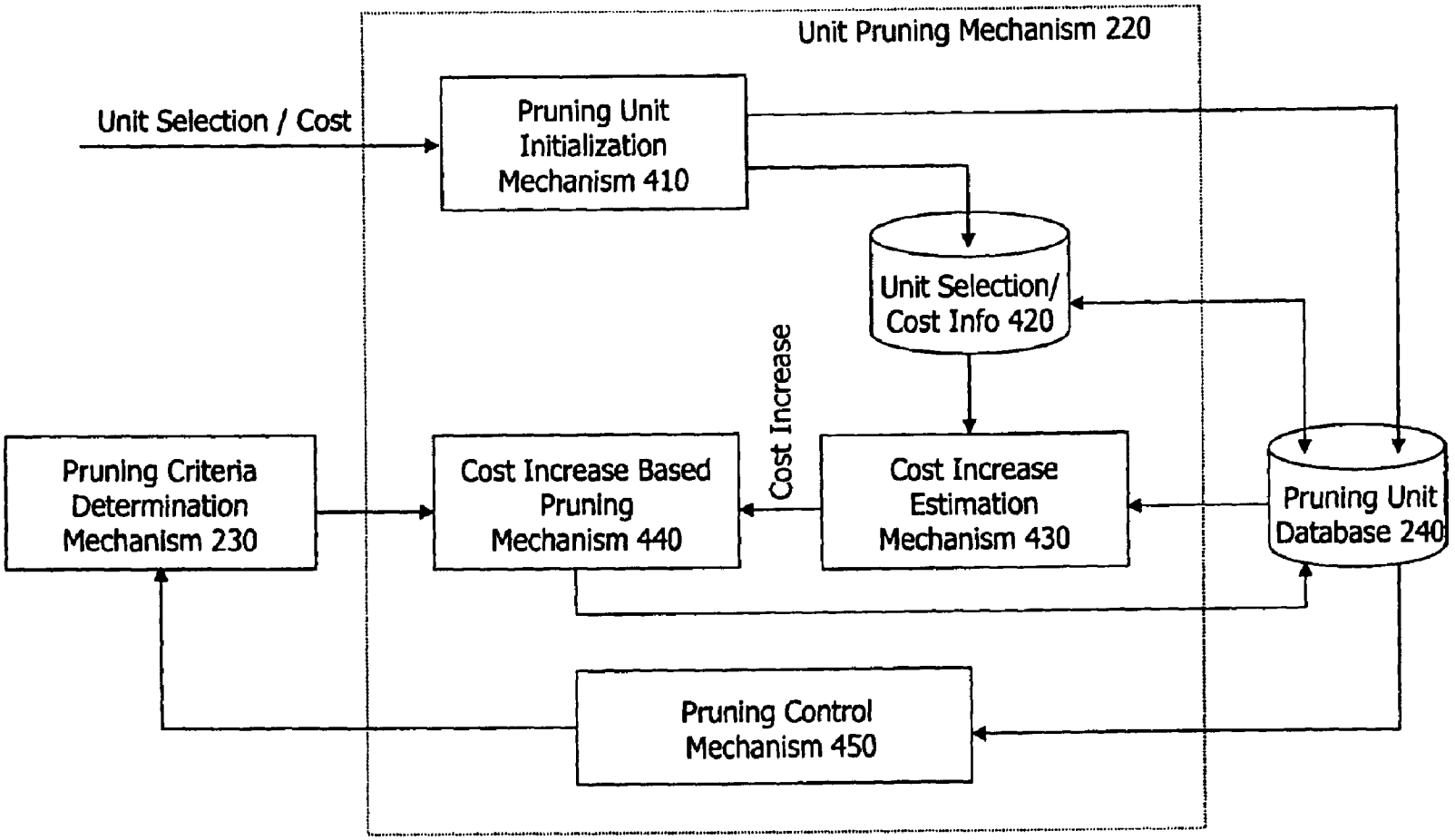
FIG. 4 describes the high level functional block diagram of an exemplary unit pruning mechanism, according to embodiments of the present invention.

FIG. 4 describes an exemplary high level functional block diagram of the unit pruning mechanism 220, according to embodiments of the present invention. The unit pruning mechanism 220 comprises a pruning unit initialization mechanism 410, a unit selection/cost information storage 420, a cost increase estimation mechanism 430, a cost increase based pruning mechanism 440, and a pruning control mechanism 450. Taking unit sequences with associated cost information generated by the unit-selection based text-to-speech mechanism 210, the pruning unit initialization mechanism 410 may first initialize the pruning unit database 240 (using the units included in the input unit sequences) and store the associated cost information in the unit selection/cost information storage 420 for pruning purposes. Although depicted in FIG. 4 as separate entities, the pruning unit database 240 and the unit selection/cost information storage 420 may be alternatively implemented as one entity.

The pruning unit initialization mechanism 410 initializes the pruning unit database 240 with only the units that are initially selected by the unit-selection based text-to-speech mechanism 210. That is, the units that are not selected by the unit-selection based text-to-speech mechanism 210 during text to speech processing for the sentences from the text database 130 will be pruned immediately are removed at the beginning from further consideration of being included in the reduced unit database 140. Therefore, all the units in the pruning unit database 240 are initially considered as potential candidates to be included in the reduced unit database 140.

The pruning unit initialization mechanism 410 places the units appearing in any of the selected unit sequences generated by the unit-selection based text-to-speech mechanism 210 into the pruning unit database 240 and the associated cost information in the unit selection/cost information storage 420. When the pruning unit database 240 and the unit selection/cost information 420 are implemented as separate entities (as depicted in FIG. 4), each piece of cost information stored in 420 may be cross indexed with respect to pruning units in the pruning unit database 240. For example, each unit stored in the pruning unit database 240 may index to one or more pieces of cost information stored in the unit selection/cost information storage 420 associated with the sentences or unit sequences which include the unit. Similarly, for each piece of cost information associated with a sentence (or a selected unit sequence), a plurality of pruning units in the database 240 may be indexed that correspond to the units that are included in the selected unit sequence. With such indices, related cost information associated with a unit sequence in which a particular unit appears can be readily determined.

A unit stored in the pruning unit database 240 may be retained if, for example, a cost increase induced when the underlying unit sequence(s) uses alternative unit(s) (when the unit is made unavailable for unit selection) is too high. Otherwise, the unit may be pruned. A unit that is pruned during the pruning process may be removed from the pruning unit database 240 (i.e., it will not be further considered as a candidate unit to be included in the reduced unit database 140). The decision of whether a unit should be removed from further consideration (pruned) depends on the magnitude of the cost increase associated with using alternative units.

The cost increase estimation mechanism 430 computes a cost increase associated with each of the units in the pruning unit database 240 and sends the estimated cost increase to the cost increase based pruning mechanism 440 that determines whether the unit should be pruned. The details about how the cost increase is computed are discussed with reference to FIGS. 5 and 9. The cost increase based pruning mechanism 440 makes a decision about whether a particular unit associated with a cost increase should be pruned according to one or more pruning criteria set up by the pruning criteria determination mechanism 230. For example, a pruning criterion may be a simple threshold of cost increase. Any unit that has a cost increase exceeding the threshold may be considered as introducing too much loss and, hence, is retained.

The pruning control mechanism 450 controls the pruning process. For example, it may monitor the current number of units remaining in the pruning unit database. 240. Given current pruning criteria, if the pruning process-yields a larger than a desired number of units in the pruning unit database 240, the pruning control mechanism 450 may invoke the pruning criteria determination mechanism 230 to update the current pruning criteria so that the remaining units can be further pruned. For example, given a cost increase threshold, if the remaining number of units in the pruning unit database 240 is still larger than a desired number, the pruning criteria determination mechanism 230, upon being activated, may increase the threshold (i.e., make the threshold higher) so that more units can be pruned using the higher threshold. Once the new threshold is adjusted, the pruning control mechanism 450 may re-initiate another round of pruning so that the new threshold can be applied to further prune the units remained in the pruning unit database 240.

Figure 5:
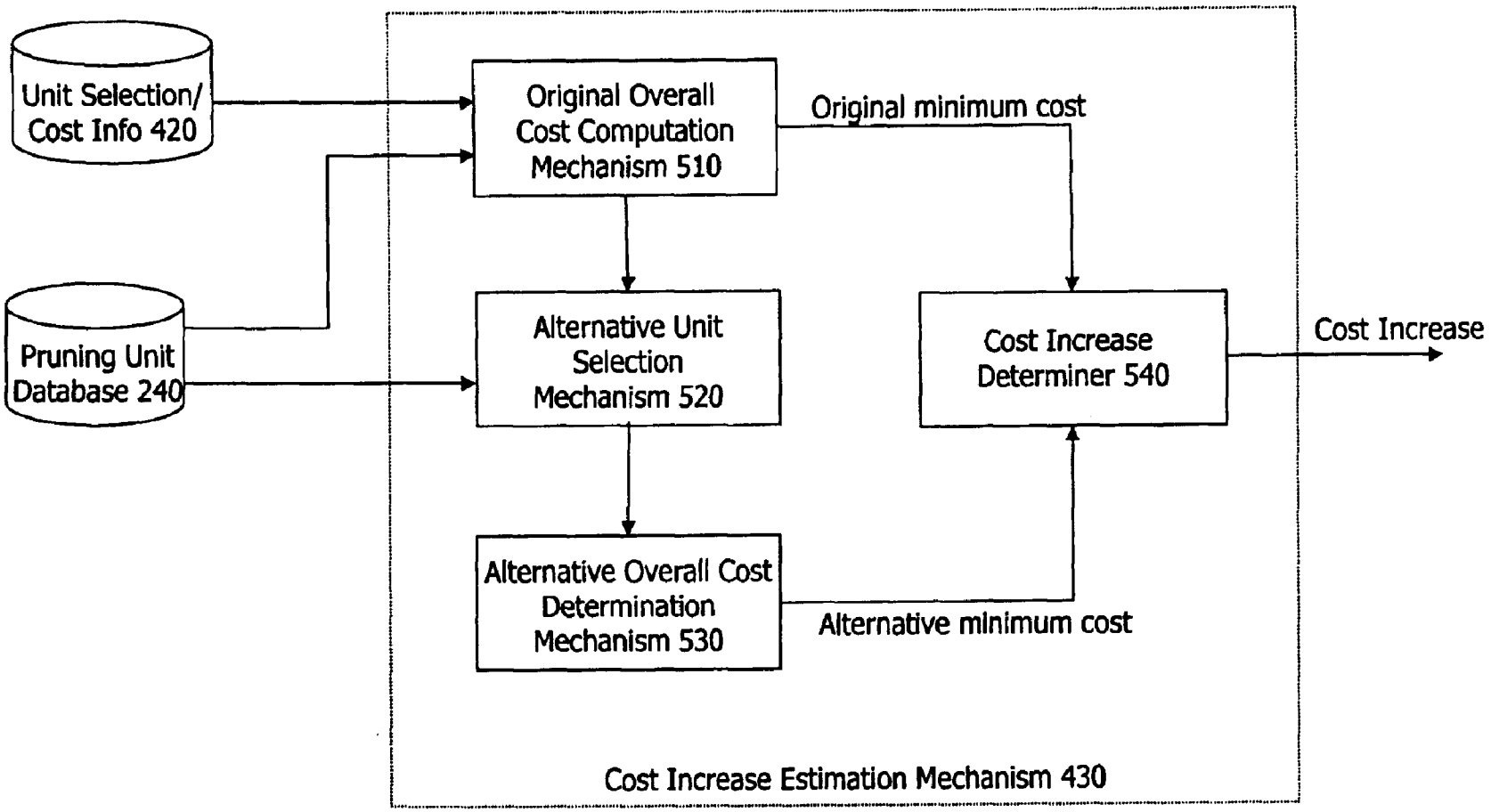
FIG. 5 depicts the high level functional block diagram of an exemplary cost increase estimation mechanism, according to embodiments of the present invention.

FIG. 5 depicts an exemplary high level functional block diagram of the cost increase estimation mechanism 430, according to embodiments of the present invention. The cost increase estimation mechanism 430 comprises an original overall cost computation mechanism 510, an alternative unit selection mechanism 520, an alternative overall cost determination mechanism 530, and a cost increase determiner 540. For each unit being considered for pruning, the original overall cost computation mechanism 510 identifies overall cost information associated with all the unit sequences, which include the underlying unit. This original overall cost associated with the unit may be computed as a summation of individual costs associated with each of such unit sequences.

To determine the merit of a unit (to be pruned) in terms of its impact on cost changes, the alternative unit selection mechanism 520 performs alternative unit selection with respect to all the unit sequences which originally include the underlying unit. During alternative unit selection, an alternative unit sequence is generated for each of the original unit sequences based on a unit database in which the underlying unit (i.e., the unit under pruning consideration) is no longer available for unit selection. For each of such generated alternative unit sequences, an alternative cost is computed. Then, the alternative overall cost determination mechanism 530 computes the alternative overall cost of the underlying unit as, for example, a summation of all the alternative costs associated with the alternative unit sequences. Finally, the cost increase determiner 540 computes the cost increase associated with the underlying unit according to the discrepancy between the original overall cost and the alternative overall cost. One exemplary computation of the discrepancy is the difference between the original overall cost and the alternative overall cost.

Figure 6:
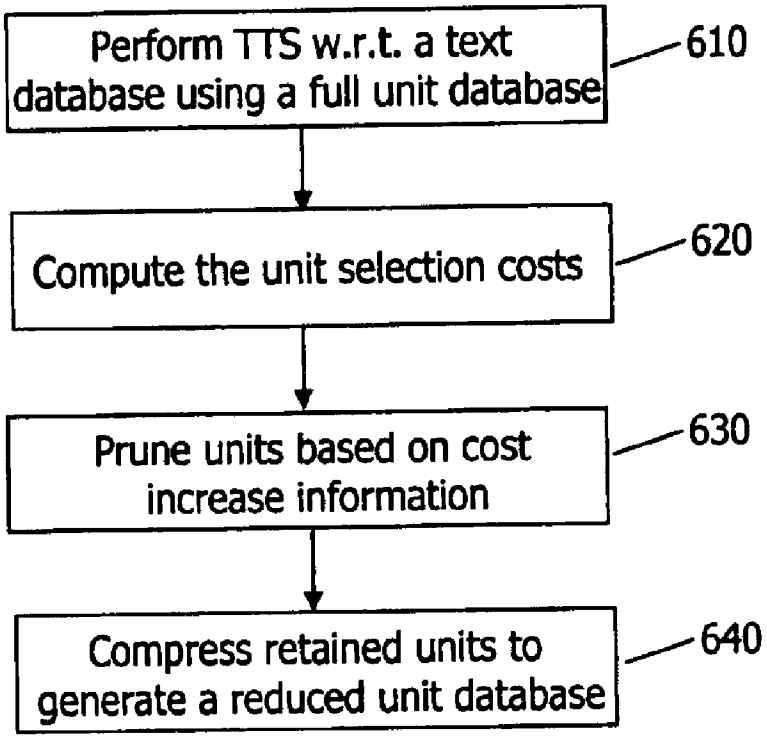
FIG. 6 is a flowchart of an exemplary process, in which a cost based subset unit generation mechanism in its first exemplary realization produces a reduced unit database based on information about cost increase, according to embodiments of the present invention.

FIG. 6 is a flowchart of an exemplary process, in which the cost based subset unit generation mechanism 110 in its first exemplary realization (depicted in FIG. 2) produces the reduced unit database 140 based on cost increase information, according to embodiments of the present invention. With this realization, units are pruned before they are compressed to generate the reduced unit database 140. Unit-selection based text to speech processing is first performed, at act 610, with respect to sentences stored in the text database 130 using the full unit database 120. For each of selected unit sequences, an associated unit selection cost is computed at act 620 and stored for unit pruning purposes.

The units selected during the initial unit-selection based text to speech processing are pruned, at act 630, using cost increase information computed based on alternative unit sequences generated using alternative units. The unit pruning process (i.e., act 630) continues until the number of retained units reaches a desired number. Pruning criteria may be adjusted between different rounds of pruning. When the pruning process is completed, the retained units are compressed, at act 640, to generate the reduced unit database 140.

Figure 7:
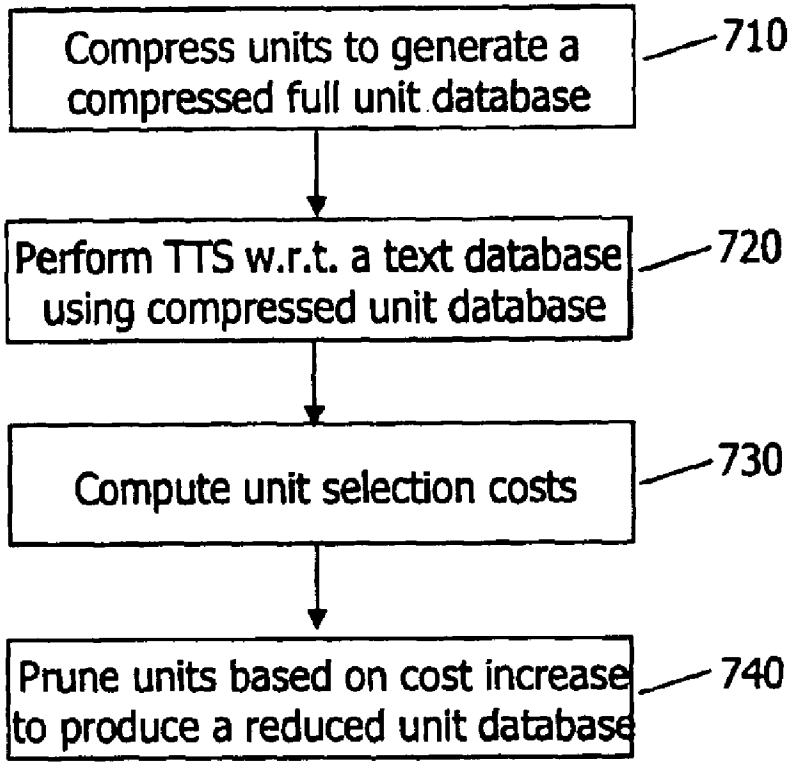
FIG. 7 is a flowchart of an exemplary process, in which a cost based subset unit generation mechanism in its second exemplary realization produces a reduced unit database based on information about cost increase, according to embodiments of the present invention.

FIG. 7 is a flowchart of an exemplary process, in which the cost based subset unit generation mechanism 110 in its second exemplary realization (depicted in FIG. 3) produces the reduced unit database 140 based on cost increase information, according to embodiments of the present invention. With this realization, units in the full unit database 120 are first compressed, at act 710, to generated the compressed full unit database 310 prior to unit-selection based text to speech processing.

Based on the compressed full unit database 310, text to speech processing is performed, at act 720, with respect to the sentences in the text database 130. The text to speech processing generates corresponding unit sequences, each of which includes a plurality of selected units. The units selected during the text to speech processing are pruned, at act 740, to produce the reduced unit database 140 with a desirable number of units. Details of the pruning process based on cost increase information in both embodiments is described in detail below.

Figure 8:
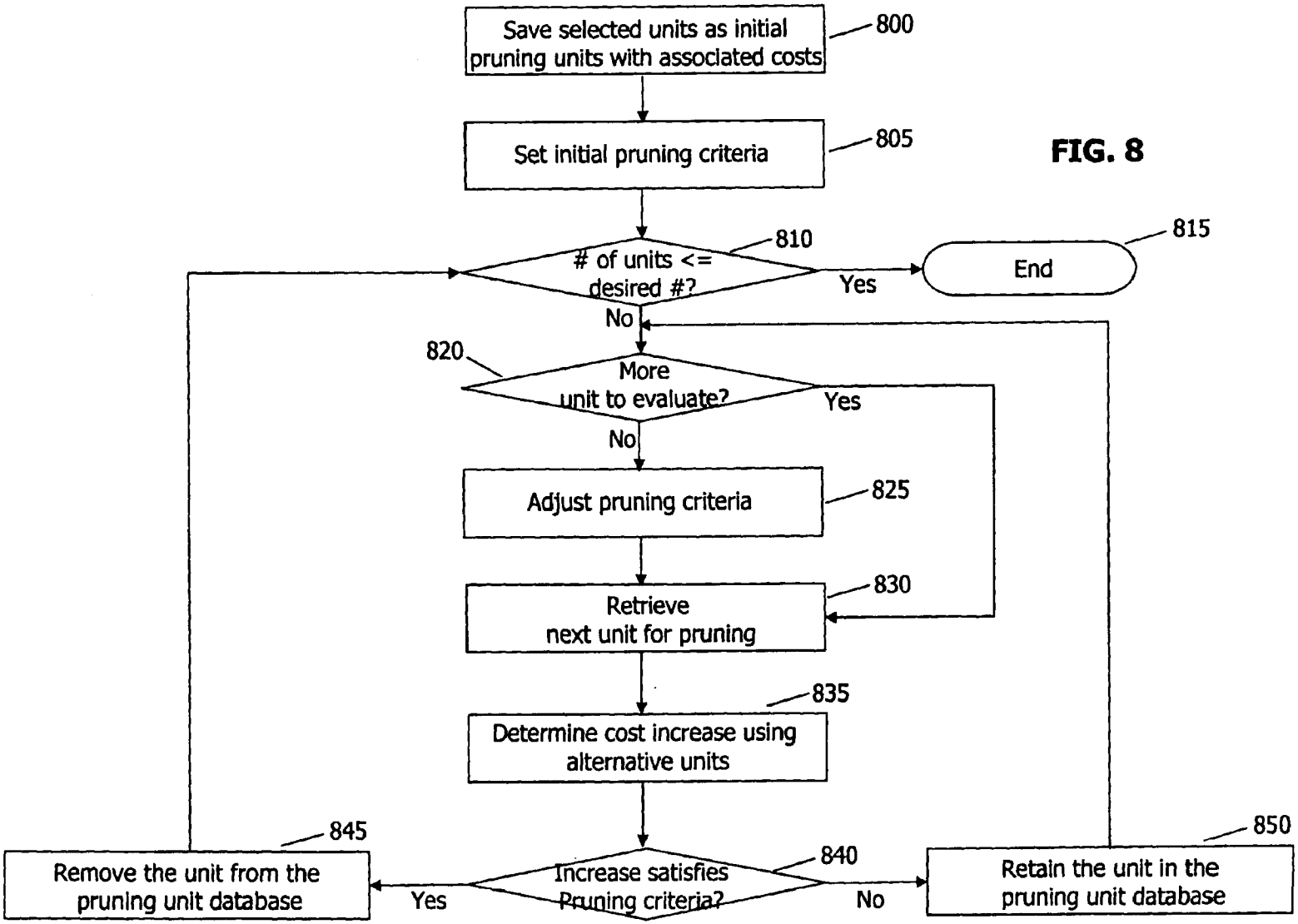
FIG. 8 is a flowchart of an exemplary process, in which units are pruned according to cost increase, according to embodiments of the present invention.

FIG. 8 is a flowchart of an exemplary process, in which units selected during text to speech processing are pruned according to cost increase information, according to embodiments of the present invention. Units included in unit sequences generated during text to speech processing are initially retained, at act 800, as pruning units (or candidate units to be included in the reduced unit database 140) and the cost information associated with the unit sequences are stored for pruning purposes. To prune the units, one or more pruning criteria are set at act 805.

If the number of retained units satisfies a desired number, determined at act 810, the pruning process ends at act 815. If there is still more retained units than the desired number and if there are more units to be evaluated with respect to the current pruning criteria (determined at act 820), next retained unit is retrieved, at act 830, for pruning purposes.

If all the retained units have been evaluated against current pruning criteria yet still exceed the desirable number, the pruning criteria are adjusted, at act 825, for next round of pruning. Once the pruning criteria are updated, next retained unit is retrieved, at act 830, for pruning purposes.

To decide whether the next retained unit should be pruned, the cost increase associated with the unit across all the sentences for which the unit is originally selected is determined at act 835. This involves the determination of the original overall cost of the unit and the alternative overall cost computed based on corresponding alternative unit sequences selected from a unit database without the underlying unit. Details about computing the cost increase is described with reference to FIG. 9.

The cost increase associated with the next retained unit is used to evaluate the current pruning criteria. If the cost increase satisfies the pruning criteria (e.g., the cost increase exceeds a cost increase threshold), determined at act 840, the next unit is pruned or removed at act 845. After the unit is removed, the unit pruning mechanism 220 examines, at act 810, whether the number of remaining units is equal to the desired number of units. If it is, the pruning process ends at act 815. Otherwise, the pruning process proceeds to the next pruning unit as described above.

If the cost increase associated with the unit does not satisfy the pruning criteria, the unit is retained at act 850. In this case, since the number of remaining units has not been changed, the pruning process continues to process the next pruning unit if there are more units to be pruned with respect to the current pruning criteria (determined at act 820).

Figure 9:
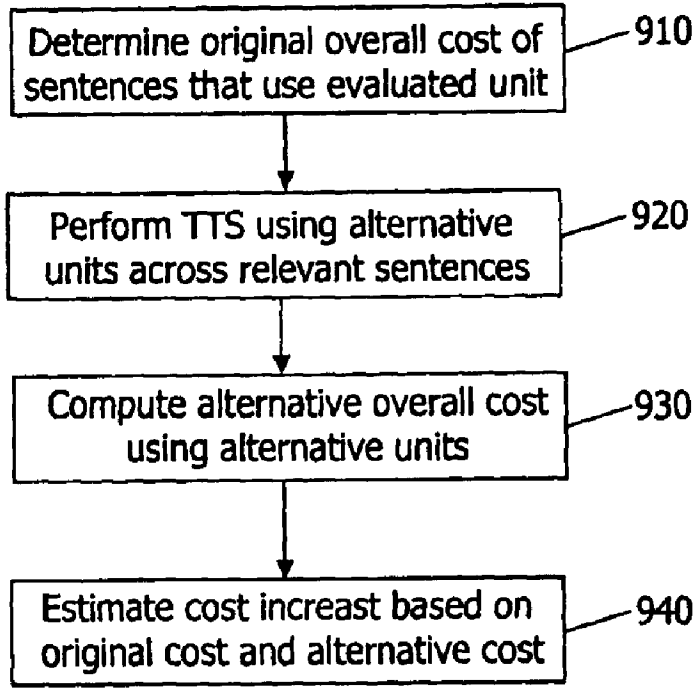
FIG. 9 is a flowchart of an exemplary process, in which a cost increase is computed based on alternative unit selections, according to embodiments of the present invention.

FIG. 9 is a flowchart of an exemplary process, in which the cost increase estimation mechanism 430 computes a cost increase based on alternative unit selections, according to embodiments of the present invention. The original overall cost associated with a pruning unit is first determined at act 910. The original overall cost may be computed across all the unit sequences which include the pruning unit as one of the selected units. The original overall cost may be computed as, but is not limited to, a summation of all the costs associated with each individual unit sequences.

The cost increase estimation mechanism 430 then proceeds to perform, at act 920, unit selection based text to speech processing with respect to the underlying sentences using a unit database in which the pruning unit is not available for selection. That is, an alternative unit sequence for each original unit sequence is generated wherein all units in the original unit sequence are still available for selection except the pruning unit. Taking the pruning unit out of the selection pool may affect the selection of more than one unit in the alternative unit sequence.

Each re-generated alternative unit sequence is associated with an alternative cost. The alternative overall cost of the pruning unit is computed, at act 930, across all the re-generated alternative unit sequences. The alternative overall cost of the pruning unit may then be computed as, but is not limited to, a summation of all the alternative costs associated with individual alternative unit sequences. Finally, the cost increase of the pruning unit is estimated, at act 940, based on the original overall cost and the alternative overall cost of the pruning unit. Such estimation may be formulated as the difference between the two overall costs or according to some other formulations that characterize the discrepancy of the two overall costs.

Figure 10:
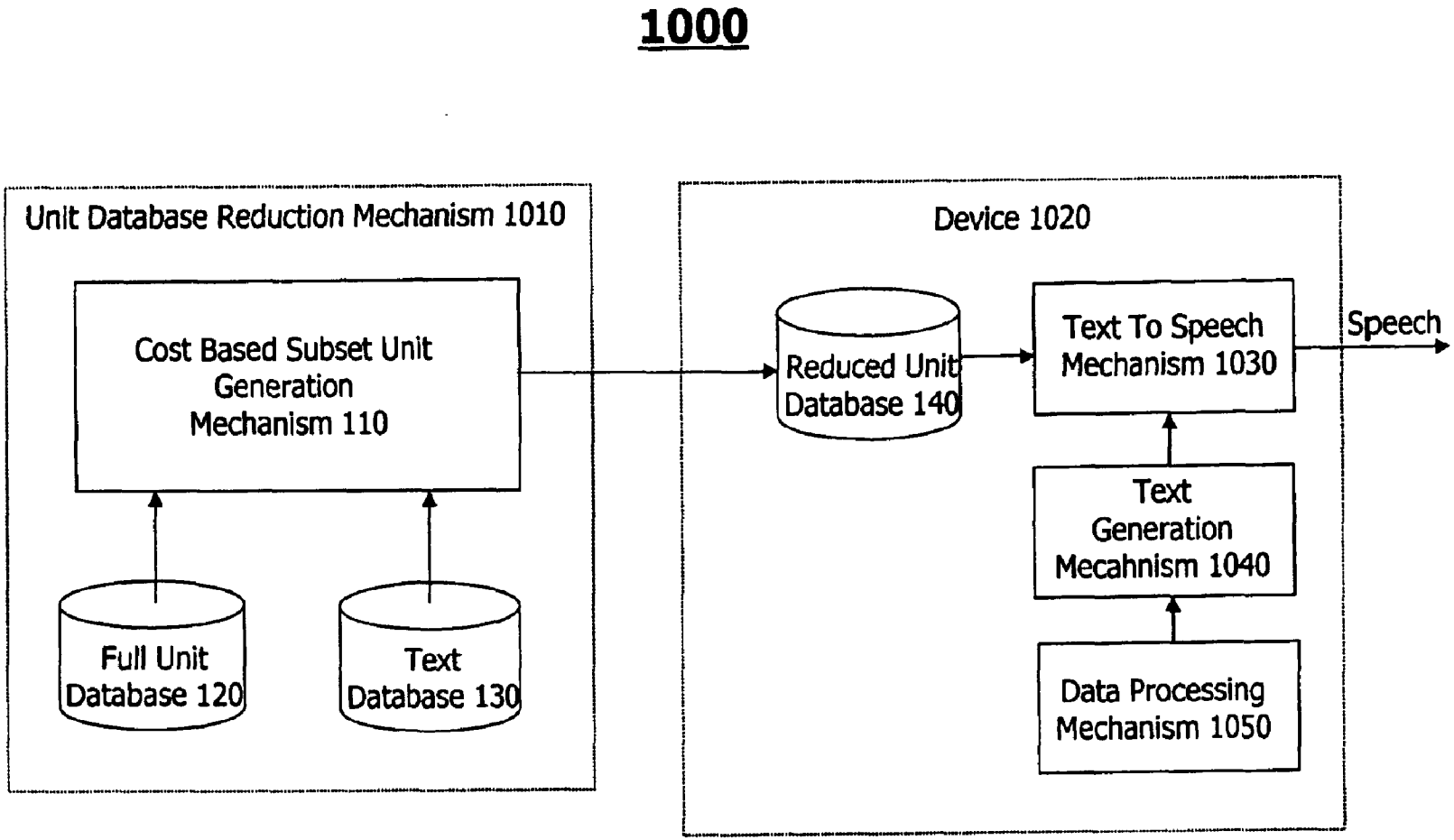
FIG. 10 depicts an exemplary framework in which a reduced unit database is generated and used in text to speech processing, according to embodiments of the present invention.

FIG. 10 depicts an exemplary framework 1000 in which a reduced unit database 140 is generated by a unit database reduction mechanism 1010 and deployed on a device 1020 for unit selection based text to speech processing, according to embodiments of the present invention. The unit database reduction mechanism 1010 performs unit database pruning functionalities described so far with reference to Fig. 1 through FIG. 9. A cost based subset unit generation mechanism in the unit database reduction mechanism 1010 produces the reduced unit database 140 by pruning the units in a full unit database 120 with respect to a plurality of sentences in a text database 130. The produced reduced unit database 140 is then used for text to speech processing carried out on the device 1020.

The device 1020 represents a generic device, which may correspond to, but is not limited to, a general purpose computer, a special purpose computer, a personal computer, a laptop, a personal data assistant (PDA), a cellular phone, or a wristwatch. In the described exemplary embodiment, the device 1020 is also capable of supporting text to speech processing functionalities. The scope of the text to speech functionalities supported on the device 1020 may depend on applications that are deployed on the device 1020 to perform text to speech operations. For example, if a voice based airline schedule inquiry application is deployed on the device 1020, the text to speech functionalities supported on the device 1020 may be determined by such an application, including, for instance, the language(s) enabled, the vocabulary supported (scope of the enabled language(s)), or particular linguistic accents (e.g., American accent and British accent of English).

The reduced unit database 140 may be generated with respect to the text to speech functionalities supported on the device 1020. Particularly, the sentences in the text database 130 used to generate the reduced unit database 140 may include ones that are relevant to the application(s) that carry out text to speech processing.

To enable text to speech capabilities on the device 1020, a text to speech mechanism 1030 may be deployed on the device 1020 and this text to speech mechanism (1030) is capable of performing unit-selection based text to speech processing using the reduced unit database 140. That is, the text to speech mechanism 1030 takes a text input and produces a speech output based on units selected from the reduced unit database 140. The text to speech mechanism 1030 may be realized as a system or application software, firmware, or hardware.

The text to speech mechanism 1030 may include different parts or components (not shown) conventionally necessary to perform unit-selection based text to speech processing. For example, the text to speech mechanism 1030 may include a front end part that performs necessary linguistic analysis on the input text to produce a target unit sequence with prosodies. The text to speech mechanism 1030 may also include a unit selection part that takes a target unit sequence as input and selects units from the reduced unit database 140 so that the selections are in accordance with the target unit sequence and specified prosodies. The selected unit sequence may then be fed to a synthesis part of the text to speech mechanism 1030 that generates acoustic signals corresponding to the speech form of the input text based on the selected unit sequence.

On the device 1020, there may be other mechanisms that support functionalities relevant to the text to speech processing capability. For instance, the device 1020 may include a text generation mechanism 1040 that is capable of producing a text string and supplying such text string as an input to the text to speech mechanism 1030. The text generation mechanism 1040 may correspond to one or more applications deployed on the device 1020 or some system processes running on the device 1020. For example, a mailbox application running on a cellular phone may allow its users to check their email messages (text). Emails from an inbox may be synthesized into speech before they can be played back to users. In this case, the mailbox application may be included in the text generation mechanism 1040. A different application running on the same cellular phone may allow a user to inquire flight departure/arrival schedules and may playback a textual response received from an airline (e.g., the airline may provide arrival schedule for a particular flight textual form to minimize the bandwidth) in speech form by invoking the text to speech mechanism 1030 to convert the text response to speech form. In this case, the airline information query application may also be considered as a text generation mechanism.

The device 1020 may also include a data processing mechanism 1050 that may invoke the text generation mechanism 1040 based on some processing results. Similar to the text generation mechanism 1040, the data processing mechanism 1050 may represent a generic data processing capability, which may include one or more application or system functions. For example, a system function of the device 1020 (e.g., a cellular phone) may support the capability of warning a cellular user that the battery needs to be recharged whenever the battery in the cellular phone is detected low. In this case, the system function on the cellular phone may monitor the battery and react accordingly after analyzing the status of the battery. In this example, the functionality of analyzing the battery status may be part of the generic data processing mechanism 1050. To generate a warning in speech form, the system function in the data processing mechanism 1050 may invoke its counterpart in the text generation mechanism 1040 to generate a text warning message, which is then fed to the text to speech mechanism 1030 to produce the speech form of the warning message.

Figure 11:
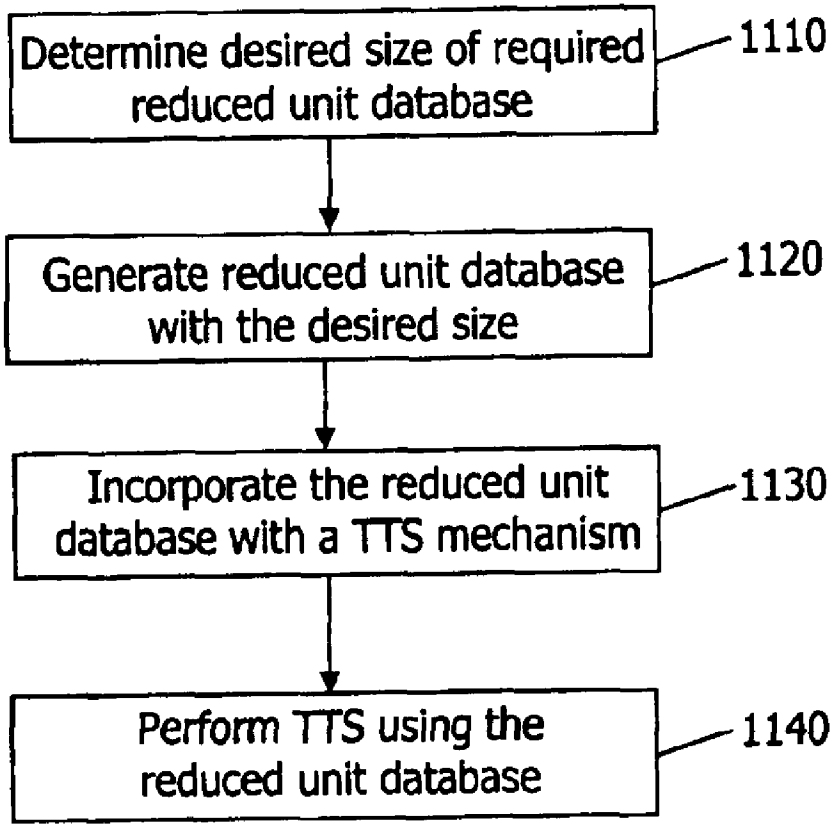
FIG. 11 is a flowchart of an exemplary process, in which a reduced unit database is generated and used in text to speech processing, according to embodiments of the present invention.

FIG. 11 is a flowchart of an exemplary process, in which the reduced unit database 140 is generated via the unit database reduction mechanism 1010 and is then incorporated with the text to speech mechanism 1130 to support unit selection based text to speech processing, according to embodiments of the present invention. In the exemplary embodiment, the text to speech mechanism 1130 and the reduced unit database 140 are deployed on the device 1020. A desired size of the reduced unit database 140 is first determined at act 1110. The desired size may be determined according to different factors related to the device 1020 on which the text to speech mechanism 1130 performs text to speech operations using the reduced unit database 140. For example, such factors may include the memory capacity available on the device 1020.

The unit database reduction mechanism 1010 generates, at act 1120, the reduced unit database 140 with the desired size based on the full unit database 120 and the text database 130. The reduced unit database 140 is then deployed, at act 1130, on the device 1020 and subsequently used, at act 1140, in text to speech processing.

While the invention has been described with reference to the certain illustrated embodiments, the words that have been used herein are words of description, rather than words of limitation. Changes may be made, within the purview of the appended claims, without departing from the scope and spirit of the invention in its aspects. Although the invention has been described herein with reference to particular structures, acts, and materials, the invention is not to be limited to the particulars disclosed, but rather can be embodied in a wide variety of forms, some of which may be quite different from those of the disclosed embodiments, and extends to all equivalent structures, acts, and, materials, such as are within the scope of the appended claims.

What is claimed is:

1. A method comprising:

determining a desired size of a reduced unit database for text to speech operations:

generating the reduced unit database of the desired size based on a full unit data base in order to minimize an overall cost in using the units in the reduced unit database to accomplish the text to speech operations; and performing the text to speech operations using the reduced unit database with respect to every sentence in a text database using units selected from the full unit database, wherein units are selected so that a cost of using the selected units to achieve text to speech is minimized;

computing a unit selection cost associated with each of the sentences in the text database; and pruning the units that are selected during the text to speech operations based on the unit selection costs to produce the reduced unit database, wherein said pruning comprises:

initializing the reduced unit database using the units selected during the text to speech operations performed with respect to the sentences in the text database;

determining an a cost increase induced when a next unit in the reduced unit database is made unavailable for unit selection based text to speech operations;

retaining the next unit in the reduced unit database if the cost increase satisfies at least one pruning criterion; and repeating said determining and said removing until at least one condition is satisfied.

2. The method according to claim 1 wherein the text to speech operations are performed by any one of:

an application software;

a firmware; and a hardware.

3. The method according to claim 1, wherein the text to speech operations are performed on a device that includes any one of:

a computer;

a personal data assistant;

a cellular phone; and a dedicated device deployed for an application.

4. The method according to claim 3, wherein the computer includes any one of:

a personal computer;

a laptop;

a special purpose computer; and a general purpose computer.

5. The method according to claim 3, wherein the desired size of the reduced unit database is determined according to at least some features of the device.

6. The method according to claim 5, wherein the features of the device include any one of:

the amount of memory available on the device; and the computation capability of the device.

7. The method according to claim 1, wherein the at least one condition includes at least one of:

the number of retained units in the reduced unit database satisfies the desired size; and the number of retained units in the reduced unit database exceeds the desired size after all the units in the reduced unit database have been processed with respect to the at least one pruning criterion.

8. The method according to claim 7, further comprising:

if the number of units in the reduced unit database exceeds the desired size after all the units in the reduced unit database have been processed with respect to the at least one pruning criterion, adjusting the at least one pruning criterion to create updated at least one pruning criterion; and performing operations between said determining and said repeating using the updated at least one pruning criterion in place of the at least one pruning criterion.

9. The method according to claim 1, wherein said determining the cost increase comprises:

determining an original overall cost across all relevant sentences for which the next unit is selected during the text to speech operations;

performing text to speech operations on the relevant sentences, wherein the next unit is made unavailable for unit selection so that at least one alternative unit are selected in place of the next unit;

computing an alternative overall cost across the relevant sentences for which the at least one alternative unit are selected during the text to speech operations; and estimating the cost increase associated with the next unit based on the original overall cost and the alternative overall cost.

10. The method according to claim 1, further comprising:

compressing the units in the reduced unit database after said pruning so that the units in the reduced unit database are stored in a compressed form.

11. The method according to claim 1, further comprising:

compressing the full unit database prior to said performing text to speech operations so that the unit selection during said performing is based on a compressed full unit database.

12. A method to generate a reduced unit database based on a full unit database, comprising:

performing text to speech operations with respect to every sentence in a text database using units selected from the full unit database, wherein units are selected so that the cost of using the selected units to achieve text to speech is minimized;

computing a unit selection cost associated with each of the sentences in the text database; and pruning the units that are selected during the text to speech operations based on the unit selection costs to produce the reduced unit database; wherein said pruning comprises:

initializing the reduced unit database using the units selected during the text to speech operations performed with respect to the sentences in the text database;

determining a cost increase induced when a next unit in the reduced unit database Is made unavailable for unit selection based text to speech operations;

retaining the next unit in the reduced unit database if the cost increase satisfies at least one pruning criterion; and repeating said determining and said removing until at least one condition is satisfied.

13. The method according to claim 12, wherein the at least one condition includes at least one of:

the number of retained units in the reduced unit database satisfies a desired size; and the number of retained units in the reduced unit database exceeds the desired size after all the units in the reduced unit database have been processed with respect to the at least one pruning criterion.

14. The method according to claim 13, further comprising:

if the number of units in the reduced unit database exceeds the desired size after all the units in the reduced unit database have been processed with respect to the at least one pruning criterion, adjusting the at least one pruning criterion to create updated at least one pruning criterion; and performing operations between said determining and said repeating using the updated at least one pruning criterion in place of the at least one pruning criterion.

15. The method according to claim 12, wherein said determining the cost increase comprises:

determining an original overall cost across all relevant sentences for which the next unit is selected during the text to speech operations:

performing text to speech operations on the relevant sentences, wherein the next unit is made unavailable for unit selection so that at least one alternative unit are selected in place of the next unit;

computing an alternative overall cost across the relevant sentences for which the at least one alternative unit are selected during the text to speech operations, and estimating the cost increase associated with the next unit based on the original overall cost and the alternative overall cost.

16. The method according to claim 15, wherein the overall cost across the relevant sentences is computed as a summation of the costs associated with individual relevant sentences.

17. The method according to claim 12, wherein the cost of using selected units to achieve text to speech with respect to a sentence includes at least one of:

context cost; and concatenation cost.

18. The method according to claim 12, further comprising:

compressing the units in the reduced unit database after said pruning so that the units in the reduced unit database are in a compressed form.

19. The method according to claim 12, further comprising:

compressing the full unit database prior to said performing text to speech operations so that the unit selection during said performing is based on a compressed full unit database.

20. A system, comprising:

a unit database reduction mechanism capable of generating a reduced unit database of a desired size from a full unit database based on cost information; and a text to speech mechanism capable of performing text to speech operations using the reduced unit database;

wherein the unit database reduction mechanism comprises: a text database including a plurality of sentences; and a cost-based subset unit generation mechanism capable of pruning the full unit database to generate the reduced unit database using cost information associated with unit selection in carrying out text to speech operations with respect to the plurality of sentences in the text database using a unit pruning mechanism capable of pruning the units selected from the full unit database to produce the reduced unit database according to the cost associated with each of the sentences and at least one pruning criterion, wherein the unit pruning mechanism further comprises:

a cost increase estimation mechanism capable of estimating a cost increase related to a pruned unit, the cost increase being induced when the pruned unit is made unavailable for unit selection during text to speech operations; and a cost increase based pruning mechanism capable of determining whether the pruned unit is to be removed according to the cost increase and the at least one pruning criterion.

21. The system according to claim 20, wherein the cost based subset unit generation mechanism comprises:

a unit selection based text to speech mechanism capable of selecting units from the full unit database with respect to the sentences in the text database and producing a cost associated with each of the sentences.

22. The system according to claim 21, further comprising a pruning criteria determination mechanism capable of adjusting the at least one pruning criterion when the reduced unit database after said pruning exceeds the desired size.

23. The system according to claim 20, wherein the cost increase estimation mechanism comprises:

an original overall cost computation mechanism capable of estimating an original overall cost associated with the pruned unit across relevant sentences for which the pruned unit is selected;

an alternative unit selection mechanism capable of performing text to speech operations an the relevant sentences, wherein the pruned unit is made unavailable for unit selection so that at least one alternative unit are selected in place of the pruned unit;

an alternative overall cost determination mechanism capable of estimating an alternative overall cost across the relevant sentences for which the at least one alternative unit are selected in place of the pruned unit; and a cost increase determiner capable of estimating the cost increase based on the original overall cost and the alternative overall cost associated the pruned unit.

24. The system according to claim 20, further comprising a unit compression mechanism capable of compressing the units in the reduced unit database after the unit pruning mechanism generates the reduced unit database to provide the reduced unit database in a compressed form.

25. The system according to claim 20, further comprising a unit compression mechanism capable of compressing the units in the full unit database to provide the full unit database in a compressed form prior to the unit selection based text to speech mechanism performs text to speech operations.

26. A unit database reduction mechanisms, comprising:

a text database including a plurality of sentences;

a full unit database; and a cost based subset unit generation mechanism capable of pruning the full unit database to produce a reduced unit database using cost information related to unit selection in carrying out text to speech operations with respect to the plurality of sentences in the text database wherein the cost based subset unit generation mechanism comprises:

a unit selection based text to speech mechanism capable of selecting units from the full unit database with respect to the sentences in the text database and producing a cost associated with each of the sentences; and a unit pruning mechanism capable of pruning the units selected from the full unit database to produce the reduced unit database, wherein the unit pruning mechanism comprises:

a cost increase estimation mechanism capable of estimating a cost increase related to a pruned unit, the cost increase being induced when the pruned unit is made unavailable for unit selection during text to speech operations; and a cost increase based pruning mechanism capable of determining whether the pruned unit is to be removed according to the cost increase and the at least one pruning criterion.

27. The system according to claim 26, further comprising a pruning criteria determination mechanism capable of adjusting the at least one pruning criterion when the reduced unit database after said pruning exceeds a desired size.

28. The system according to claim 26, wherein the cost increase estimation mechanism comprises:

an original overall cost computation mechanism capable of estimating an original overall cost associated with the pruned unit across relevant sentences for which the pruned unit is selected;

an alternative unit selection mechanism capable of performing text to speech operations on the relevant sentences, wherein the pruned unit is made unavailable for unit selection so that at least one alternative unit is selected in place of the pruned unit;

an alternative overall cost determination mechanism capable of estimating an alternative overall cost across the relevant sentences for which the at least one alternative unit is selected in place of the pruned unit; and a cost increase determiner capable of estimating the cost increase based on the original overall cost and the alternative overall cost associated the pruned unit.

29. The system according to claim 26, further comprising a unit compression mechanism capable of compressing the units in the reduced unit database after the unit pruning mechanism generates the reduced unit database to provide the reduced unit database in a compressed form.

30. The system according to claim 26, further comprising a unit compression mechanism capable of compression the units in the full unit database to provide the full unit database in a compressed form prior to the unit selection based text to speech mechanism performs text to speech operations.

31. An article comprising a storage medium having stored thereon instructions that, when executed by a machine, result in the following:

determining a desired size of a reduced unit database for text to speech operations: generating the reduced unit database of the desired size based on a full unit database, wherein the reduced unit database is generated to minimize an overall cost in using the units in the reduced unit database to accomplish the text to speech operations; and performing the text to speech operations using the reduced unit database, wherein said generating the reduced unit database comprises:

performing text to speech operations with respect to every sentence in a text database using units selected from the full unit database, wherein units are selected so that the cost of using the selected units to achieve text to speech is minimized;

computing a unit selection cost associated with each of the sentences in the text database;

pruning the units that are selected during the text to speech operations based on the unit selection costs to produce the reduced unit database; wherein said pruning comprises:

initializing the reduced unit database using the units selected during the text to speech operations performed with respect to the sentences in the text database;

determining a cost increase induced when a next unit in the reduced unit database is made unavailable for unit selection based text to speech operations;

retaining the next unit in the reduced unit database if the cost increase satisfies at least one pruning criterion; and repeating said determining and said removing until at least one condition is satisfied.

32. The article according to claim 31, wherein the desired size of the reduced unit database is determined according to at least some features of a device.

33. The article according to claim 32, wherein the features of the device include any one of:

the amount of memory available on the device;

the computation capability of the device.

34. The article according to claim 31, wherein the at least one condition includes at least one of:

the number of retained units in the reduced unit database satisfies the desired size; and the number of retained units in the reduced unit database exceeds the desired size after all the units in the reduced unit database have been processed with respect to the at least one pruning criterion.

35. The article according to claim 43, the instructions, when executed by a machine, further result in:

if the number of units in the reduced unit database exceeds the desired size after all the units in the reduced unit database have been processed with respect to the at least one pruning criterion, adjusting the at least one pruning criterion to create updated at least one pruning criterion; and performing operations between said determining and said repeating using the updated at least one pruning criterion in place of the at least one pruning criterion.

36. The article according to claim 31, wherein said determining the cost increase comprises:

determining an original overall cost across all relevant sentences for which the next unit is selected during the text to speech operations;

performing text to speech operations on the relevant sentences, wherein the next unit is made unavailable for unit selection so that at least one alternative unit are selected in place of the next unit;

computing an alternative overall cost across the relevant sentences for which the at least one alternative unit are selected during the text to speech operations; and estimating the cost increase associated with the next unit based on the original overall cost and the alternative overall cost.

37. The article according to claim 31, the instructions, when executed by a machine, further result in:

compressing the units in the reduced unit database after said pruning so that the units in the reduced unit database are stored in a compressed form.

38. The article according to claim 31, the instructions, when executed by a machine, further result in:

compressing the full unit database prior to said performing text to speech operations so that the unit selection during said performing is based on a compressed full unit database.

39. An article comprising a storage medium having stored thereon instructions for generating a reduced unit database based on a full unit database that, when executed result in:

performing text to speech operations with respect to every sentence in a text database using units selected from the full unit database, wherein units are selected so that a cost of using the selected units to achieve text to speech is minimized;

computing a unit selection cost associated with each of the sentences in the text database; and pruning the units that are selected during the text to speech operations based on the unit selection costs to produce the reduced unit database: wherein said pruning comprises:

initializing the reduced unit database using the units selected during the text to speech operations performed with respect to the sentences in the text database:

determining a cost increase induced when a next unit in the reduced unit database is made unavailable for unit selection based text to speech operations;

retaining the next unit in the reduced unit database if the cost increase satisfies at least one pruning criterion; and repeating said determining and said removing until at least one condition is satisfied.

40. The article according to claim 39, wherein said pruning comprises:

initializing the reduced unit database using the units selected during the text to speech operations performed with respect to the sentences in the text database;

determining an cost increase induced when a next unit in the reduced unit database is made unavailable for unit selection based text to speech operations;

retaining the next unit in the reduced unit database if the cost increase satisfies at least one pruning criterion; and repeating said determining and said removing until at least one condition is satisfied.

41. The article according to claim 40, wherein the at least one condition includes at least one of:

the number of retained units in the reduced unit database satisfies a desired size; and the number of retained units in the reduced unit database exceeds the desired size after all the units in the reduced unit database have been processed with respect to the at least one pruning criterion.

42. The article according to claim 40, wherein the instructions, when executed by a machine, further result in:

if the number of units in the reduced unit database exceeds a desired size after all the units in the reduced unit database have been processed with respect to the at least one pruning criterion, adjusting the at least one pruning criterion to create updated at least one pruning criterion; and performing operations between said determining and said repeating using the updated at least one pruning criterion in place of the at least one pruning criterion.

43. The article according to claim 40, wherein said determining the cost increase comprises:

determining an original overall cost across all relevant sentences for which the next unit is selected during the text to speech operations;

performing text to speech operations on the relevant sentences, wherein the next unit is made unavailable for unit selection so that at least one alternative unit is selected in place of the next unit;

computing an alternative overall cost across the relevant sentences for which the at least one alternative unit is selected during the text to speech operations; and estimating the cost increase associated with the next unit based on the original overall cost and the alternative overall cost.

44. The article according to claim 43, wherein the overall cost across the relevant sentences is computed as a summation of the costs associated with individual relevant sentences.

45. The article according to claim 39, wherein the cost of using selected units to achieve text to speech with respect to a sentence includes at least one of:

a context cost; and a concatenation cost.

46. The article according to claim 39, the instructions, when executed by a machine, further result in:

compressing the units in the reduced unit database after said pruning so that the units in the reduced unit database are in a compressed form.

47. The article according to claim 39, the instructions, when executed by a machine, further result in:

compressing the full unit database prior to said performing text to speech operations so that the unit selection during said performing is based on a compressed full unit database.

* * * * *